US005445096A

United States Patent [19]

Aoki et al.

[11] Patent Number: 5,445,096

[45] Date of Patent: Aug. 29, 1995

[54] HULL PROTECTION SYSTEM FOR LIQUEFIED GAS SHIP

[75] Inventors: Eiji Aoki, Yokohama; Koichoro Yamada, Tokyo; Tatsuhiko Yukitomo, Yokohama, all of Japan

[73] Assignee: Ishikawajima-Harima Jukogyo Kabushiki Kaisha, Tokyo, Japan

[21] Appl. No.: 240,620

[22] Filed: May 11, 1994

[30] Foreign Application Priority Data

May 20, 1993 [JP] Japan ..... 5-118499
May 27, 1993 [JP] Japan ..... 5-126092

[51] Int. Cl.[6] ..... B63B 25/16

[52] U.S. Cl. ..... 114/74 A; 220/571; 220/901

[58] Field of Search ..... 114/74 A; 220/571, 901, 220/562

[56] References Cited

U.S. PATENT DOCUMENTS 3,071,094 1/1963 Leroux ..... 114/74 A
3,537,415 11/1970 Jackson ..... 114/74 A
3,547,301 12/1970 Ffooks ..... 114/74 A
4,106,424 8/1978 Schuler et al. ..... 220/901 X
4,245,748 1/1981 Kvamsdal ..... 114/74 A X
4,488,500 12/1984 Mototsuna et al. .

OTHER PUBLICATIONS

Patent Abstracts of Japan, vol. 9, No. 149 (M-390) (1872) 25 Jun. 1985 and JP-A-60 026 900 (K. Motozuna) 9 Feb. 1985 * Abstract *.
Patent Abstracts of Japan, vol. 13, No. 83 (M-802) (3431) 27 Feb. 1989 and JP-A-63 279 994 (Mitsubishi Heavy Industries Ltd.) 17 Nov. 1988 * Abstract *.

*Primary Examiner*—Sherman Basinger
*Attorney, Agent, or Firm*—Oblon, Spivak, McClelland, Maier & Neustadt

[57] ABSTRACT

A tank body is covered at its outer surface with an insulation material and is supported by tank supports arranged on a bottom of an inner shell of a hull. A drainer for discharging leaked liquid is mounted each at least at four corners on a lower surface of the insulation material at the bottom of the tank body. A drip tray is arranged below each drainer. Sealing is provided between the tank support and the insulation material. Leaked liquid is reliably collected and disposed by the drip tray.

6 Claims, 8 Drawing Sheets

PRIOR ART

HULL PROTECTION SYSTEM FOR LIQUEFIED GAS SHIP

BACKGROUND OF THE INVENTION

The present invention relates to a hull protection system for a liquefied gas ship.

Generally, a liquefied gas ship has a structure as shown in FIG. 1 in which a tank body 1 made of aluminum alloy is covered on its outer surface with a relatively hard insulation material 6 such as polyurethane foam and is supported by a plurality of heat insulating tank supports 2 which in turn are arranged on a bottom of an inner shell 3 of a hull. Since the tank body 1 may be expanded or contracted due to temperature change caused by absence or presence of liquefied gas in it, to attach or bond the insulation material 6 at its edge to the tank support 2 would cause the material 6 to be distorted, resulting in damage of the material 6. Therefore, the material 6 directly mounted on the tank body 1 is not attached or bonded at its edge to the tank support 2; but, as shown in FIG. 2, a heat insulating material 16 such as glass wool is filled between the edge of the material 6 and the tank support 2 for prevention of transmission of external heat to the tank body 1 through a gap between the edge of the material 6 and the tank support 2.

In the event of leakage of liquefied gas stored at extremely low temperature in the tank body 1, the inner shell 3 may be exposed to the leaked liquid and turned to low temperature, becoming brittle. In order to overcome this, there have been proposed that the inner shell 3 is made of the same material as the tank body 1 or that a trough 17 is arranged as shown by imaginary lines in FIG. 2 to receive the liquefied gas leaked to an outer periphery of the tank support 2.

However, to make the inner shell 3 of the same material as the tank body 1 will extremely increase the cost for constructing the liquefied gas ship and therefore is next to impossible for practical application. To provide the trough 17 for each tank support 2 is also disadvantageously uneconomical.

To solve the above problems, the present invention has as its object to provide a hull protection system for a liquefied gas ship which is simple in structure so as to not increase a cost for construction and which is reliable for collection and disposal of leaked liquid to prevent the inner shell from becoming brittle due to low temperature.

BRIEF SUMMARY OF THE INVENTION

According to the present invention, a hull protection system for a liquefied gas ship having a tank body covered at its outer surface with an insulation material and tank supports arranged on a bottom of an inner shell of a hull for supporting the tank body comprises drainers for discharging leaked liquid, said drainers being mounted each at least at four corners of a lower surface of the insulation material at a bottom of the tank body, a drip tray arranged blow each of the drainers and seal means between said tank supports and said insulation material.

A horizontal projection may be formed on an outer periphery of the tank support intermediately of height of the tank support, with the insulation material mounted on the bottom of the tank body being abutted at its edge on an upper surface of the projection of the tank support while a lower surface of the insulation material is made coplanar to a lower surface of the projection and a liquid-sealing tape is attached or applied on the co-plane, thereby providing the seal means.

A horizontal projection may be formed on an outer periphery of the tank support intermediately of height of the tank support, with the insulation material which is a hard insulation material and is mounted on the bottom of the tank body being abutted at its edge on an upper surface of the projection of the tank support while a soft insulation material is arranged on a lower surface of the hard insulation material with its edge being attached or bonded to a side of the projection, thereby providing seal means.

A flange for preventing the leaked liquid from splashing may be provided on an upper edge of the drip tray. Partition plates may be arranged in the form of lattice on an inner bottom of the drip tray. A plurality of heat insulating supports may be interposed between the drip tray and the bottom of the inner shell.

Therefore, in the hull protection system according to the present invention, in the event of leakage of liquefied gas stored at extremely low temperature in the tank body, the seal means prevents the leaked liquid from passing between the tank support and insulation material and the leaked liquid is collected into the drip tray or trays through the drainer or drainers. Since the drip tray is arranged below each of the drainers which in turn are mounted each at least at four corners of the lower surface of the insulation material at the bottom of the tank body 1, the leaked liquid can be received without fail by at least one of the drip trays even when the ship tilts in any direction.

In the case where the horizontal projection is formed on the outer periphery of the tank support intermediately of height of the tank support, with the insulation material mounted on the bottom of the tank body being abutted at its edge on the upper surface of the projection of the tank support while a lower surface of the insulation material is made coplanar to the lower surface of the projection and the liquid-sealing tape is attached on the co-plane, thereby providing the seal means, the insulation material is closely in engagement with the upper surface of the projection with no gap therebetween so that heat is perfectly insulated. Even when the insulation material is expanded or contracted in horizontal direction due to temperature change, this results in no damage of the insulation material since the edge of the insulation material can follow such expansion or contraction to slide along the upper surface of the projection. The tape is attached or applied on the co-plane over a range extending from a position closer to the edge of the lower surface of the insulation material to the lower surface of the projection, which facilitates attaching operation and ensures perfect liquid-sealing.

In the case where the soft insulation material is arranged on the lower surface of the hard insulation material, the soft insulation material is expanded and contracted due to temperature change while being attached or bonded to the side of the projection, which ensures perfect cold insulation and liquid sealing and prevents damage.

In the case where a flange for preventing the leaked liquid from splashing is provided on the upper edge of the drip tray, partition plates being arranged in the form of lattice on the inner bottom of the drip tray, the heat insulating supports being interposed between the drip tray and the bottom of the inner shell, the drip tray is partially supported by the heat insulating supports and is not covered at its bottom surface by heat insulating material. Therefore, a considerable area of the bottom surface of the drip tray is exposed to external air. Furthermore, because of the partition plates in the form of lattice on the inner bottom of the drip tray, a heat receiving area of the collected leaked liquid is increased owing to a fin effect of the partition plates. These promote evaporation of the collected leaked liquid and make it possible to evaporate all of an assumed or estimated quantity of leaked liquid. Until the total quantity of leaked liquid is evaporated, movement of the leaked liquid collected in the drip tray caused by movement of the ship is suppressed by the partition plates while splash of the leaked liquid out of the drip tray is prevented by the flange provided on the upper edge of the drip tray.

The present invention will become more apparent from the following description of preferred embodiments thereof taken in conjunction with the accompanying drawings.

DETAILED DESCRIPTION OF THE PREFERRED EMBODIMENTS

Figure 1:
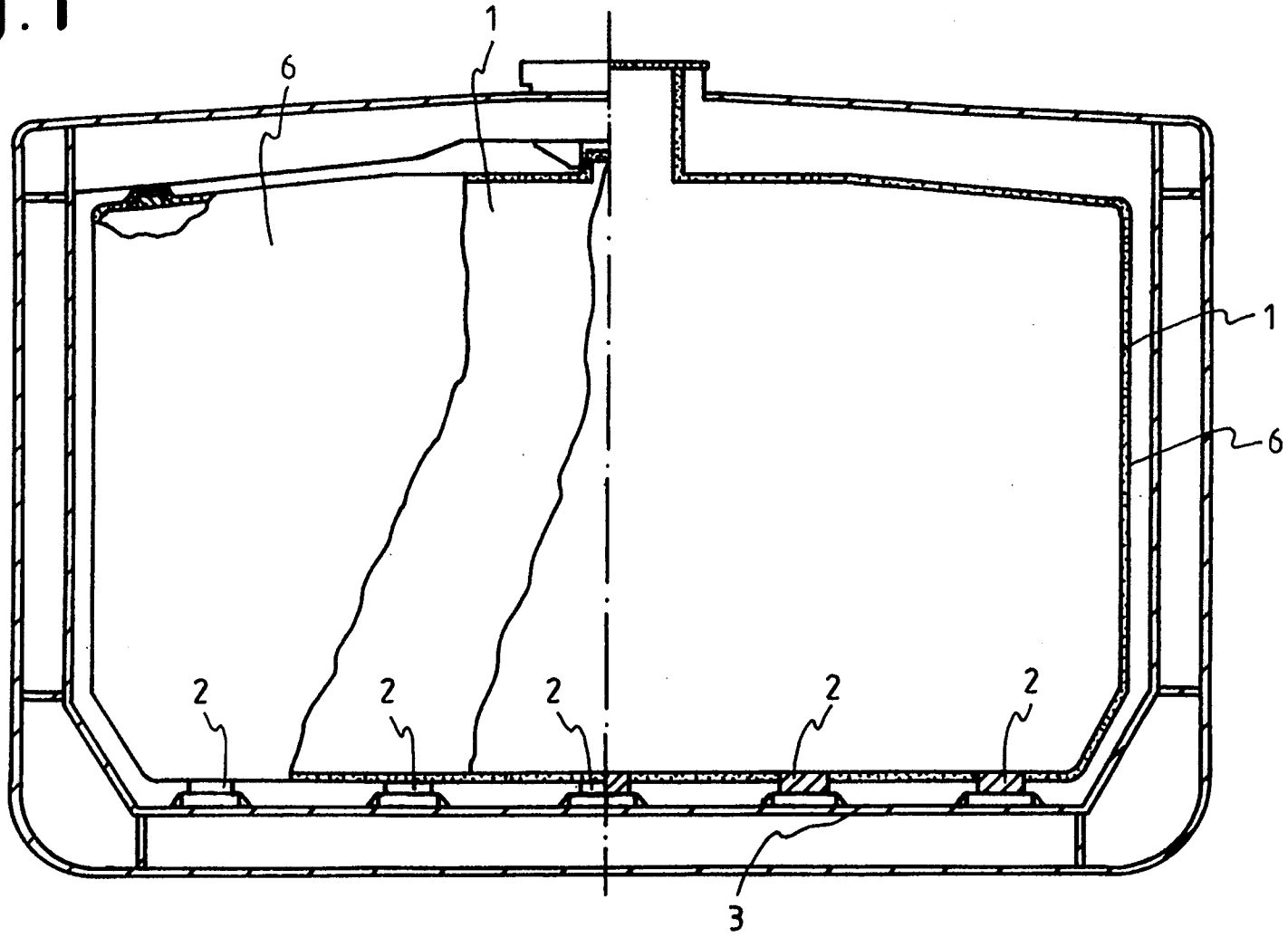
FIG. 1 is a general transverse section showing a conventional tank body in a liquefied gas ship.
Figure 2:
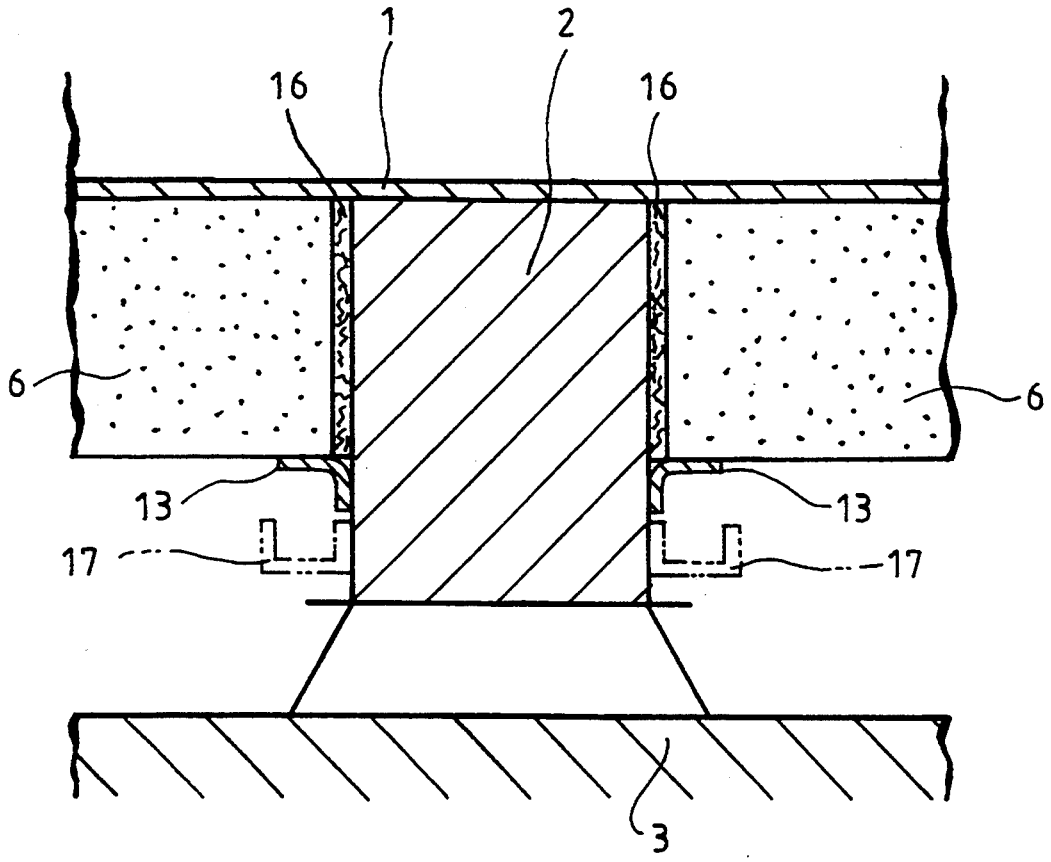
Fig. 2 PRIOR ART
FIG. 2 is a section showing a conventional tank support for a tank body.
Figure 3:
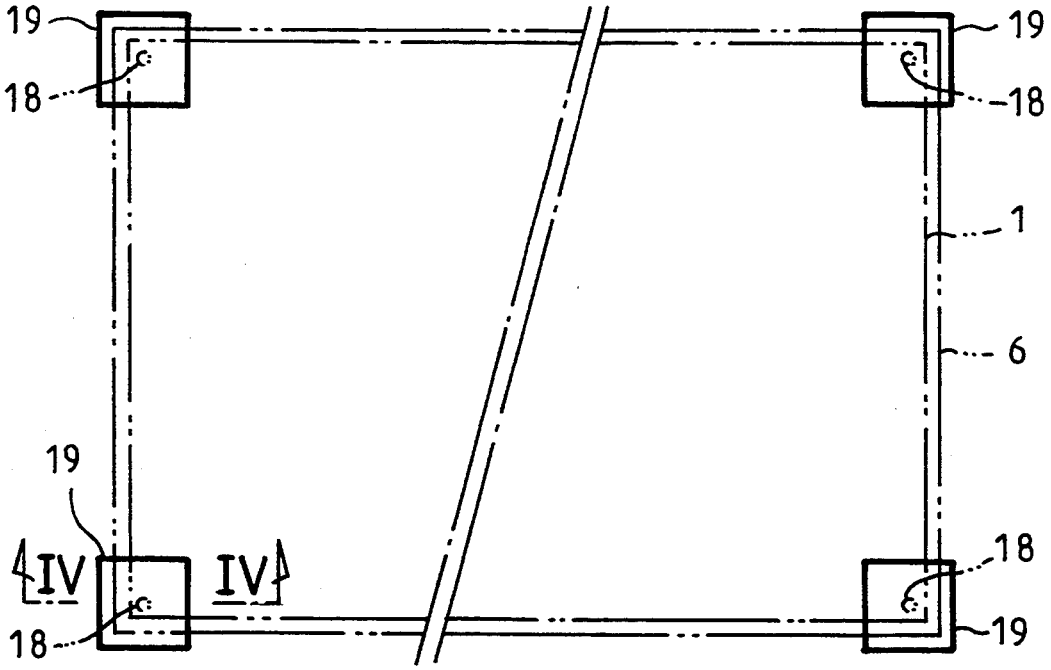
FIG. 3 is a general plan view of an embodiment of the present invention.
Figure 4:
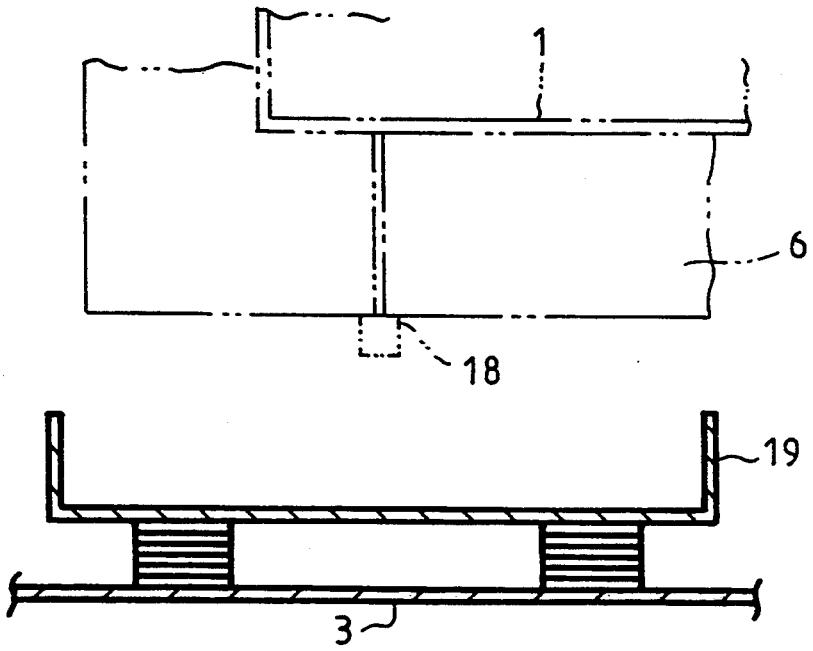
FIG. 4 is a section taken along the line IV—IV in FIG. 3.

FIGS. 3 and 4 show an embodiment of the present invention in which just as the prior art shown in FIGS. 1 and 2, a tank body 1 is covered on its outer surface with a relatively hard insulation material 6 such as polyurethane foam and is supported by tank supports 2 arranged on a bottom of an inner shell 3 of a hull of a liquefied gas ship. At a bottom of the tank body 1, drainers 18 for discharging leaked liquid are mounted each at least at four corners on a lower surface of the insulation material 6. Arranged below each of the drainers 18 is a drip tray 19 made of aluminum alloy (See FIG. 4) and provided between the tank support 2 and the insulation material 6 is a seal means 20 (See FIGS. 5 to 7). It is needless to say that, in the case where there is a portion which is at a lower position than the other portions, such as a pump well disposed at the bottom of the tank body 1, the drainer 18 for discharging leaked liquid may be mounted on a lower surface of the insulation material 6 at the very portion and the drip tray 19 made of aluminum alloy may be arranged below said drainer 18.

Figure 5:
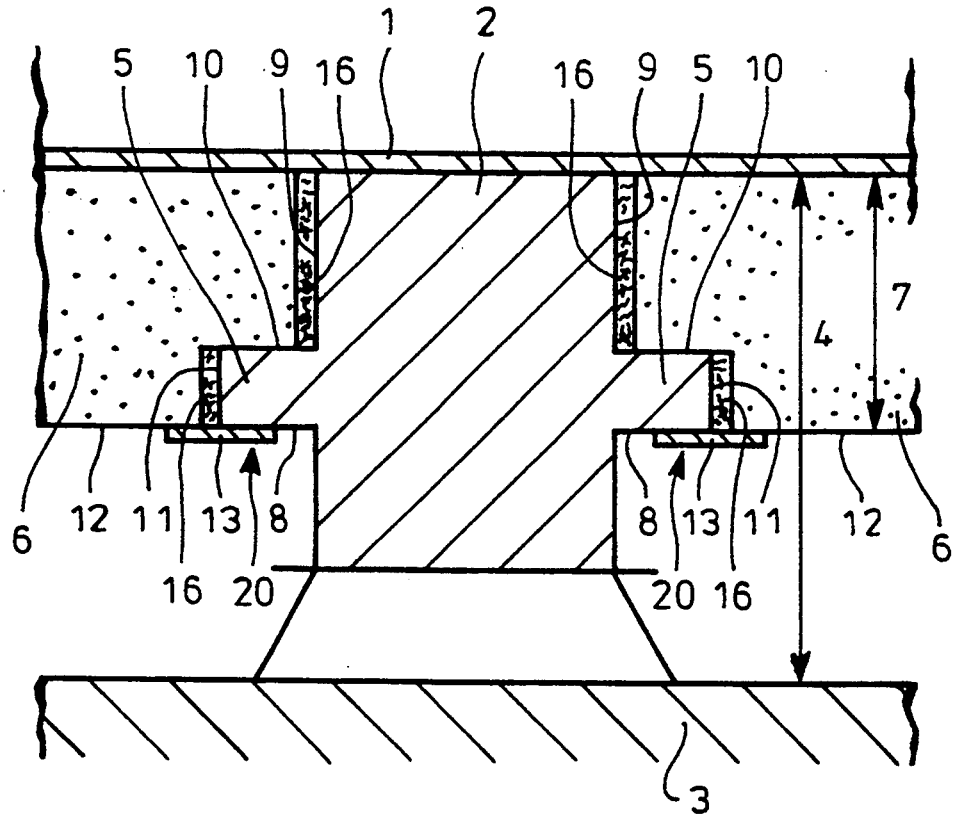
FIG. 5 is a section showing an embodiment of seal means.

The seal means 20 may be, for example, as shown in FIG. 5. More specifically, a horizontal projection 5 is formed or integrally provided on an outer periphery of the tank support 2 intermediately of the height 4 of the tank support 2. The insulation material 6 mounted on the outer surface of the bottom of the tank body 1 is designed to have thickness 7 equal to the distance from the outer surface of the bottom of the tank body 1 to a lower surface 8 of the projection 5. The insulation material 6 is abutted at its edge on an upper surface 10 of the projection 5 while keeping the material 6 spaced apart from an outer periphery 9 of the tank support 2 above the projection 5 and from a side 11 of the projection 5. A heat insulating material 16 such as glass wool is filled between the edge of the material 6 and the outer periphery 9 of the tank support 2 above the projection 5 and between the edge of the material 6 and the side 11 of the projection 5. Since the thickness 7 of the material 6 is made equal to the distance from the outer surface of the bottom of the tank body 1 to the lower surface 8 of the projection 5, the lower surface 8 of the projection 5 is coplanar to the lower surface 12 of the material 6. On this co-plane, a liquid-sealing tape 13 is attached or applied over an area extending from a position closer to an edge of the lower surface 12 of the material 6 to the lower surface 8 of the projection 5.

Next, description will be given on operation of the above embodiment.

In the event of leakage of liquefied gas stored at extremely low temperature in the tank body 1, the seal means 20 prevents the leaked liquid from passing between the tank support 2 and the insulation material 6. The leaked liquid is collected into the drip tray or trays 19 through the drainer or drainers 18. Since the drip tray 19 is arranged below each of the drainers 18 which in turn are mounted each at least at four corners of the tank body 1, the leaked liquid can be received by at least one of the trays 19 without fail even when the ship tilts in any direction.

When the seal means 20 is arranged as shown in FIG. 5, the insulation material 6 is closely fitted on the upper surface 10 of the projection 5 with no gap therebetween, which ensures perfect heat insulation. Even when the insulation material 6 is expanded or contracted in horizontal direction due to temperature change, no damage occurs because of the edge of the insulation material 6 sliding along upper surface 10 of the projection 5. Since the tape 13 is attached or applied on the plane over the area extending from the position closer to the edge of the lower surface 12 of the insulation material 6 to the lower surface 8 of the projection 5, the tape can be applied in easier manner than the case as shown in FIG. 2 where the tape 13 is applied over an area including a corner bent at right angle between the edge of the lower surface of the insulation material 6 and the side of the tank support 2.

Figure 6:
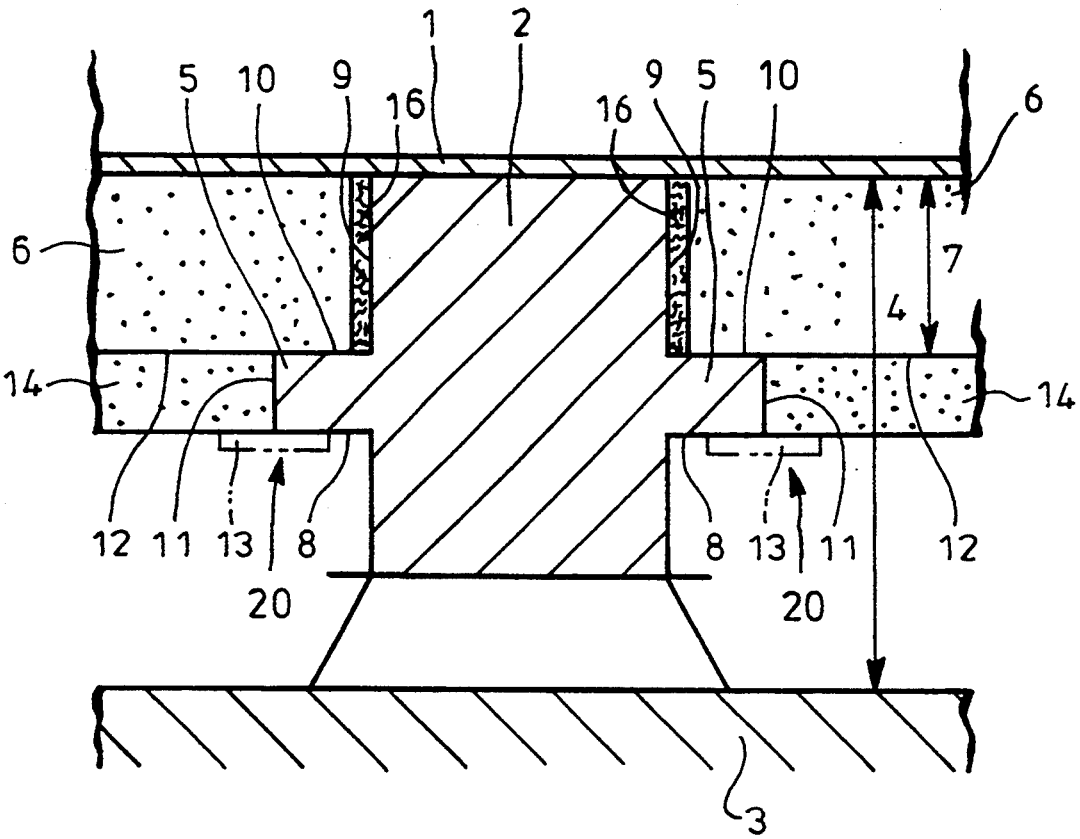
FIG. 6 is a section showing a further embodiment of the seal means.

FIG. 6 represents a further embodiment of the seal means 20. A horizontal projection 5 is formed or integrally provided on the outer periphery of the tank support 2 intermediately of the height 4 of the tank support 2. The relatively hard insulation material 6 mounted on the outer surface of the bottom of the tank body 1 is designed to have thickness 7 equal to the distance from the outer surface of the bottom of the tank body 1 to the upper surface 10 of the projection 5. The insulation material 6 is abutted at its edge on the upper surface 10 of the projection 5 and a relatively soft insulation material 14 such as polyethylene foam is arranged on the lower surface 12 of the relatively hard insulation material 6. The material 14 is designed to have a thickness equal to that of the projection 5 and the edge of the material 14 is attached or bonded to the side 11 of the projection 5.

When the seal means 20 is arranged as shown in FIG. 6, damage of the insulation materials 6 and 14 is prevented even in expansion or contraction of the same in horizontal direction due to temperature change since the edge of the material 6 slides along the upper surface 10 of the projection 5 and the material 14 can be expanded or contracted while its edge is bonded to the side 11 of the projection. This eliminates damage, ensures heat insulation and prevents the leaked liquefied gas from passing to the inner shell 3 of the hull.

It is needless to say that, also in the seal means 20 shown in FIG. 6, the liquid-sealing tape 13 may be applied on an area extending from a position closer to the edge of the lower surface of the insulation material 14 to the lower surface 8 of the projection 5.

Figure 7:
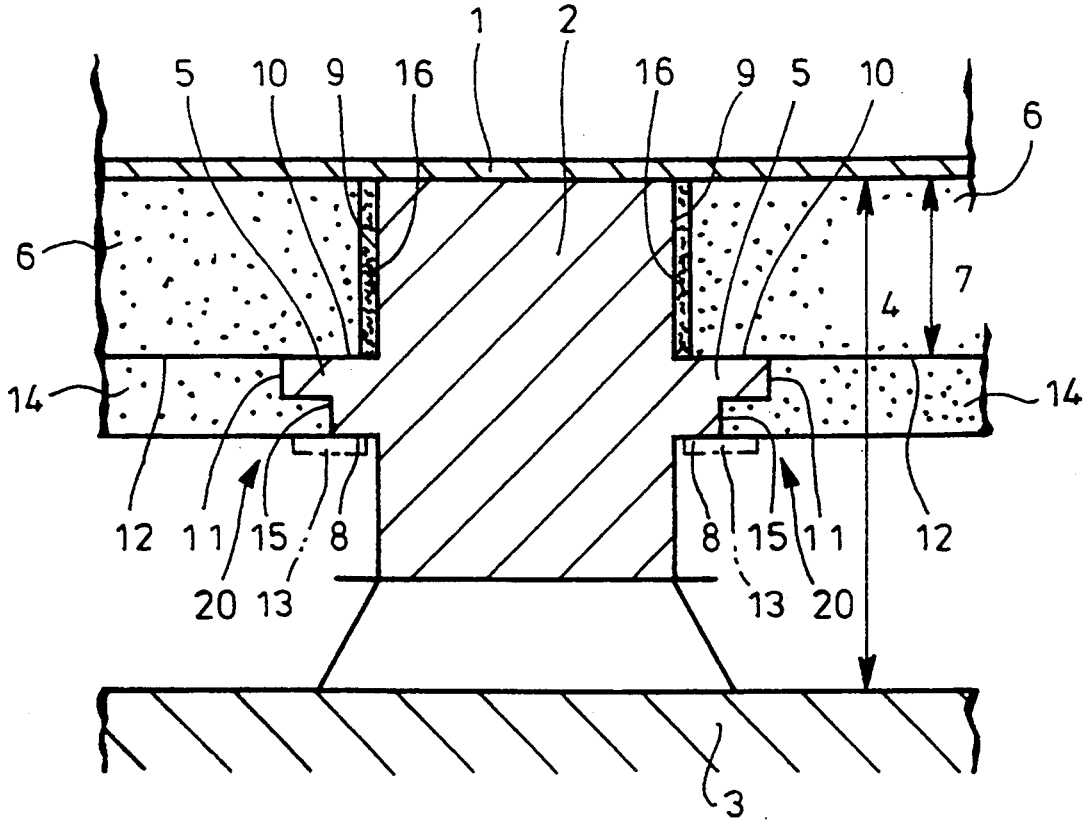
FIG. 7 is a section of a still further embodiment of the seal means.

FIG. 7 shows a still further embodiment of the seal means 20. A horizontal projection 5 is formed or integrally provided on the outer periphery of the tank support 2 intermediately of height 4 of the tank support 2 and a graded step 15 facing downward is arranged on the lower surface of the projection 5. The relatively hard insulation material 6 mounted on the outer surface of the bottom of the tank body 1 is designed to have thickness 7 equal to the distance from the outer surface of the bottom of the tank body 1 to the upper surface 10 of the projection 5. The insulation material 6 is abutted at its edge on the upper surface 10 of the projection 5 of the tank support 2. On the lower surface 12 of the material 6, a relatively soft insulation material 14 such as polyethylene foam is arranged. The material 14 is designed to have a thickness equal to that of the projection 5 and is attached or bonded at its edge to the side 11 of the projection 5 and to the graded step 15.

In the case of the seal means 20 arranged as shown in FIG. 7, even when the insulation materials 6 and 14 are expanded or contracted in horizontal direction due to temperature change, no damage occurs since the edge of the hard insulation material 6 slides along the upper surface 10 of the projection 5 and the soft insulation material 14 can be expanded or contracted while its edge is attached or bonded to the side 11 of the projection 5 and to the graded step 15. This contributes to elimination of damage, ensures heat insulation and prevents the leaked liquefied gas from passing to the inner shell 3 of the hull, in a more reliable manner than in the embodiment of FIG. 6.

In the case of the seal means 20 shown in FIG. 7, the soft insulation material 14 has bonding surfaces in both horizontal and vertical directions. This facilitates bonding by close fitting and ensures more reliable mounting than in the embodiment of FIG. 6.

It is needless to say that, also in the seal means 20 of FIG. 7, a liquid-sealing tape 13 may be applied over an area extending from a position closer to the edge of the lower surface of the insulation material 14 to the lower surface 8 of the projection 5 as needs demand.

Figure 8:
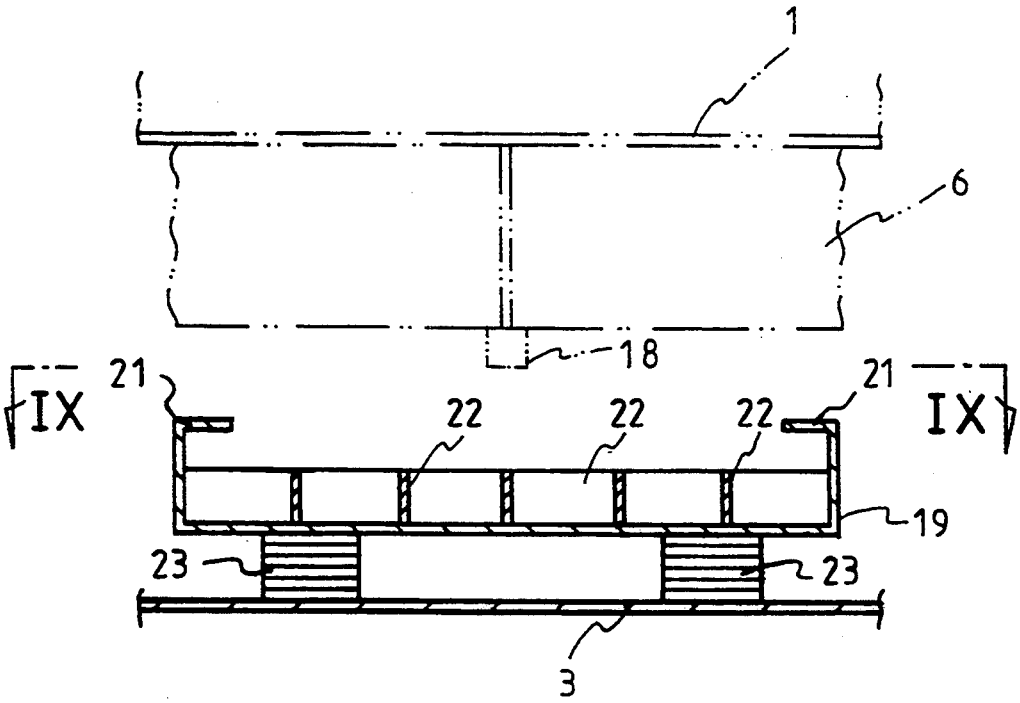
FIG. 8 is a section showing a variation of a drip tray.
Figure 9:
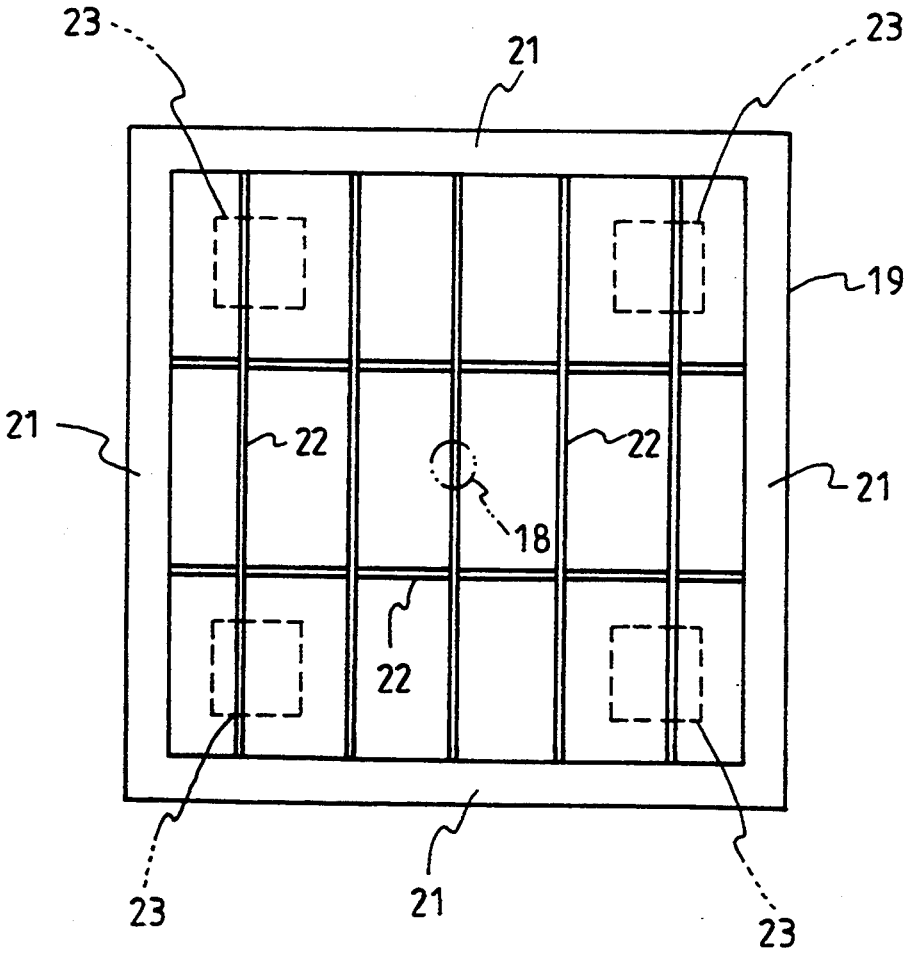
FIG. 9 is a view looking in the direction of arrows IX—IX in FIG.

FIGS. 8 and 9 represent a variation of the drip tray 19 as described above. A flange 21 for preventing the leaked liquid from splashing is formed or provided on an upper edge of the drip tray 19 and partition plates 22 are provided in the form of lattice on an inner bottom of the drip tray 19. Further, a plurality of heating insulating supports 23 made of plywood or the like are interposed between the drip tray 19 and the bottom of the inner shell 3 of the hull.

In the case where the drip tray 19 is arranged as shown in FIGS. 8 and 9, in the event of leakage of liquefied gas stored at extremely low temperature in the tank body 1, the seal means 20 prevents the liquid from leaking between the tank support 2 and the insulation material 6. The leaked liquid is collected into the drip tray or trays 19 through the drainer or drainers 18. The drip tray 19 is partially supported by the heat insulating supports 23 and is not covered at its bottom surface by heat insulating material. As a result, a considerable area of the bottom surface of the drip tray 19 is exposed to external air; and because of the partition plates 22 in the form of lattice on the inner bottom of the drip tray 19, a heat receiving area of the leaked liquid thus collected is increased by a fin effect of the partition plates 22. These promote evaporation of the collected leaked liquid and makes it possible to evaporate total assumed or estimated quantity of leaked liquid.

Until the total quantity of the leaked liquid is evaporated, movement of the leaked liquid collected in the drip tray 19 caused by the movement of the ship is suppressed by the partition plates 22 and the flange 21 on the upper edge of the drip tray 19 prevents splash of the leaked liquid out of the drip tray 19.

Thus, the leaked liquid can be perfectly collected and disposed and the inner shell 3 of the hull is prevented from becoming brittle due to low temperature while the cost for construction is suppressed by simplification of the structure.

It is to be understood that the hull protection system for a liquefied gas ship according to the present invention is not limited to the above embodiments and that modifications may be made without departing from the true spirit of the present invention.

As described above, it is possible according to the hull protection system for a liquefied gas ship of the present invention to reliably collect and dispose leaked liquid while suppressing cost increase by a simplified structure and to prevent the inner shell of the hull from becoming brittle due to low temperature.

What is claimed is:

1. A hull protection system for a liquefied gas ship having a tank body covered at its outer surface with an insulation material and tank supports arranged on a bottom of an inner shell of a hull for supporting the tank body, the hull protection system comprising drainers for discharging leaked liquid, said drainers being mounted each at least at four corners of a lower surface of the insulation material at a bottom of the tank body, a drip tray arranged below each of the drainers and seal means between said tank supports and said insulation material.

2. A hull protection system according to claim 1, wherein a horizontal projection is formed on an outer periphery of the tank support at an intermediate position with respect to a height of the tank support, the insulation material mounted on a bottom of the tank body being abutted at its edge on an upper surface of the projection, a lower surface of the projection being coplanar to a lower surface of the insulation material, a liquid-sealing tape being attached or applied on the co-plane, thereby providing the seal means.

3. A hull protection system according to claim 2, wherein a flange for preventing splashing of leaked liquid is provided on an upper edge of the drip tray, partition plates being arranged in the form of a lattice on an inner bottom of the drip tray, a plurality of heat insulating supports being interposed between said drip tray and a bottom of the inner shell of the hull.

4. A hull protection system according to claim 1, wherein a horizontal projection is formed on an outer periphery of the tank support at an intermediate position with respect to a height of the tank support, the insulation material which is a hard insulation material and is mounted on a bottom of the tank body being abutted at its edge on an upper surface of the projection, a soft insulation material being arranged on a lower surface of said hard insulation material, the soft insulation material being bonded to a side of said projection, thereby providing the seal means.

5. A hull protection system according to claim 4, wherein a flange for preventing splashing of leaked liquid is provided on an upper edge of the drip tray, partition plates being arranged in the form of a lattice on an inner bottom of the drip tray, a plurality of heat insulating supports being interposed between said drip tray and a bottom of the inner shell of the hull.

6. A hull protection system according to claim 1, wherein a flange for preventing splashing of leaked liquid is provided on an upper edge of the drip tray, partition plates being arranged in the form of a lattice on an inner bottom of the drip tray, a plurality of heat insulating supports being interposed between said drip tray and a bottom of the inner shell of the hull.

* * * * *

UNITED STATES PATENT AND TRADEMARK OFFICE

CERTIFICATE OF CORRECTION

PATENT NO. : 5,445,096

DATED : August 29, 1995

INVENTOR(S) : Eiji AOKI, et al.

It is certified that error appears in the above-indentified patent and that said Letters Patent is hereby corrected as shown below:

On the title page, in Item [75], the second inventor's name should read:

--Koichiro YAMADA--

Signed and Sealed this

Twentieth Day of August, 1996

*Attest:*

Bruce Lehman

BRUCE LEHMAN

*Attesting Officer*

*Commissioner of Patents and Trademarks*